US007217191B2

(12) United States Patent
Cordell

(10) Patent No.: US 7,217,191 B2
(45) Date of Patent: May 15, 2007

(54) GAMING DEVICE WITH RETRACTABLE REMOTE CONTROLLER

(76) Inventor: Mark Allen Justin Cordell, 1190 S. Harrison St., Denver, CO (US) 80210

( * ) Notice: Subject to any disclaimer, the term of this patent is extended or adjusted under 35 U.S.C. 154(b) by 594 days.

(21) Appl. No.: 10/346,484

(22) Filed: Jan. 16, 2003

(65) Prior Publication Data

US 2004/0140617 A1 Jul. 22, 2004

(51) Int. Cl.
*A63F 9/24* (2006.01)

(52) U.S. Cl. ..... 463/37; 463/20; 463/46; 273/138.1

(58) Field of Classification Search ..... 463/20, 463/42; 273/148 B, 143 R, 292; 242/385, 242/385.3, 400
See application file for complete search history.

(56) References Cited

U.S. PATENT DOCUMENTS

| | | | | |
|---|---|---|---|---|
| 4,335,809 | A | 6/1982 | Wain | |
| 4,403,777 | A | 9/1983 | Del Principe et al. | |
| 4,524,636 | A * | 6/1985 | Nishikawa | 74/527 |
| 4,799,683 | A | 1/1989 | Bruner, Jr. | |
| 5,168,969 | A * | 12/1992 | Mayhew | 191/12.2 R |
| 5,413,357 | A | 5/1995 | Schulze et al. | |
| D359,518 | S | 6/1995 | Mathews | |
| 5,715,020 | A * | 2/1998 | Kuroiwa et al. | 348/734 |
| 5,742,680 | A * | 4/1998 | Wilson | 380/227 |
| 5,770,533 | A | 6/1998 | Franchi | |
| 5,791,731 | A | 8/1998 | Infanti | |
| 6,058,288 | A | 5/2000 | Reed et al. | |
| 6,270,410 | B1 * | 8/2001 | DeMar et al. | 463/20 |
| 6,638,166 | B2 * | 10/2003 | Hedrick et al. | 463/20 |

OTHER PUBLICATIONS

Top Web Results for "cable", "tethered" and "hardwired". [online] [retrieved Apr. 28, 2006] Retrieved from Dictionary.com <URL:http://dictionary.reference.com/search>.*

* cited by examiner

*Primary Examiner*—Robert E. Pezzuto
*Assistant Examiner*—Alex F. R. P. Rada, II
(74) *Attorney, Agent, or Firm*—Lee G. Meyer, Esq.; Meyer & Associates, LLC

(57) ABSTRACT

A gaming system with a retractable remote controller is provided to remotely play a "slot" type gaming device. The retractable remote controller is tethered to the slot machine by a flexible connector such that upon initiation of play the retractable remote controller can be removed from its home position on the slot machine and at the end of play is automatically returned. The retractable remote controller can be a hand held or lap held device, which is battery-operated or hard wired to the slot machine. Advantageously, a single player can simultaneously operate retractable remote controllers from two or more machines. The retractable remote controller is advantageously alarmed to prevent tampering.

20 Claims, 2 Drawing Sheets

GAMING DEVICE WITH RETRACTABLE REMOTE CONTROLLER

BACKGROUND OF THE INVENTION

1. Field of the Invention

The present invention relates generally to remotely controlled gaming systems; and, more particularly, to remotely controlled slot machines.

2. Description of Related Art

Gaming systems and gambling devices have been popular for ages. Cards and dice have a history of their own. In recent years, pinball machines and mechanical gaming devices have become well known. With the advent of electrical devices to replace mechanical devices, more sophisticated gaming systems were developed, including home entertainment systems that interface with the home TV set. PlayStation® and Nintendo 64® systems are two examples.

One type of popular gaming device involves gambling on the outcome of the play. These gambling devices are a very popular form of entertainment. One type of popular gambling device is the "slot machine." Early slot machines had a mechanical pull arm, which activated a play of the device by rotating reels or wheels through a series of mechanical devices including springs, levers, pulleys, toggles, and/or cams. Because of the mechanical pull arm these highly popular gambling machines became affectionately known as "one arm bandits."

In accordance with the play or spin of the slot machine, the mechanical reels have visible symbols, which rotate when the reels are set into rotation. The relationships, in which these visible symbols on the reels come to rest when the reels stop spinning, represent the outcome of the play and correspond to a winning or losing combination. Historically, mechanical reels were stopped by a braking device, such as an indexing wheel fixed to each reel having indexing grooves into which a pin or a tripping arm assembly entered randomly. The tripping arm assembly included ratchets and pawls, as well as springs, which "timed out" to release the pins and stop the rotation of the reels in sequence. In modern machines, there are electronic random circuits, which "time out" to trip the braking mechanism to stop the spinning reels.

Many senior citizens and handicapped persons, as well as repeat players and dedicated gamblers, have found that repeatedly pulling the arm of the one arm bandit can be tiresome and often difficult. To alleviate this problem, in modern slot machines, a "power button" is used to electronically activate the rotation of the wheels rather than the mechanical pull of the lever. Electronic slot machines utilize computerized random number generators to determine the probability of reel position selection. In some slot machines simulated electronic reels have replaced mechanical reels. In still other embodiments, CRTs are used to present symbols or icons on the screen in a manner similar to the random breaking of mechanical wheels.

Irrespective of the mechanism, the slot machine operation is the same, with players positioned at a station in front of the devise for extended periods of time making repeated plays. With the advent of "bill changers" a player no longer had to insert a coin or token for every spin or play. Likewise the machine "payout," which used to be in coins at the end of a play, is now handled by credits and deductions, displayed on the consol showing the player the amount remaining in his "bank." In addition, present machines have consol displays showing the amount played for a particular spin, and the amount the player wins as a result of the spin. These amounts are added or subtracted from his "bank."

Thus, the modern slot machine utilizes electronics to reduce the physical interface of the player with the machine. Remaining at a station in front of a slot machine, or sometimes multiple machines, is not only tiring, but in some cases can actually cause infirmaries such as back problems and the like. Additionally, handicapped persons, who are unable to exhibit much upper torso mobility, are not able to remain at these positions for long periods of time or in some instances cannot access these machines at all.

Many players enjoy playing two or three slot machines at the same time. Furthermore, many players would prefer to sit back comfortably on a stool or a chair at a location two or three feet or more away from the slot machine. Conventional slot machines do not readily accommodate these desires.

A large gaming industry has grown-up around the Las Vegas, Nev. casino model, typified by large, well-lighted playing floors which operate 365 days a year, 24 hours a day. Gaming, in this manner, has grown to multi-billion dollar per year entertainment industry. One attraction for players is the atmosphere and ambience of the casino setting. Many attempts have been made to reduce the strain so that patrons can play machines longer, thus increasing revenue. For example, in U.S. Pat. No. 6,270,410 issued to De Mar at al., it has been suggested that remote controller devises, including cable connected or hand-held, wireless remote controllers or movable laptop keyboards, which allow remote operation of the devise would be advantageous. The controllers and devises suggested resemble TV remotes and/or laptop computers. Additionally, it is suggested that free-standing remotes would, not only be plausible, but also preferable as the interface medium between remote and machine. Others have suggested alternatives that have not met with great success.

First, remote devises, which could be carried off or which could operate machines from substantial distance, would interrupt the flow of the casino, as well as being costly to replace. Additionally, cabled devises that were able of use by patrons at a distance from the machine would present a nuisance, as well as a hazard, if they were not replaced properly upon termination of play. Further, having computer keyboard type apparatus would substantially mar the familiar "playing consol" attribute of the machine. Finally, even if the cabled remote devises were acceptable, disgruntled players may rip them from machines without notice by management.

Therefore, it would be advantageous to have a simple inexpensive remote device, which resembled the familiar consol and replaced, or was in addition to, the standard consol, which was lap or hand held and which was retractable, such that upon initiation of play the patron could remove and extend the remote consol a specified distance from the machine and at the end of play would be automatically retracted to its original position, on or proximate, the slot machine. In addition, it would be advantageous to have an alarmed connector cord, so that if the retractable remote controller device were removed or the connector cord severed, an alarm would be triggered.

SUMMARY OF THE INVENTION

In accordance with the broad aspect of the instant invention, a "slot" type gaming machine comprised of at least one indicator, usually a display, to communicate to the player the outcome of the game; a monetary input slot to receive the gaming script (usually bills or coins) to activate the game for play; at least one initiator to initiate play; at least one script dispenser for dispensing script which includes winnings of the play; a retractable remote controller which is operatively associates with and spaced apart from "slot" type gaming machine to remotely initiate play, and a flexible connector or cable tethering the retractable remote controller and the "slot" type gaming machine, wherein activation of the machine or play releases the flexible connector allowing the controller to be removed from its resting position and activates the retractable remote controller for play; and, termination of play of the machine automatically retracts the flexible connector returning the retractable remote controller to its original position.

In one embodiment, the flexible connector is alarmed, such that severing the retractable remote controller from the connector will initiate the alarm. In a preferred embodiment a retractable remote controller comprises the machine consol and can be actuated and the machine played through the controller while it rests in its original position as well as when it is removed from its rest position for use as a retractable remote controller.

In one aspect, the system of the instant invention, readily allows a single player to simultaneously play two or three machines. The "slot" type gaming machine of the instant invention also allows customers to remotely control the games in the slot machines from a comfortable distance away from the slot machines while standing or reclining, or otherwise sitting, in a chair, stool, etc.

The "slot" type gaming machine further features a retractable remote controller, which is operatively associated with and spaced from the slot machine to remotely play the game on the slot machine and attached to the "slot" type gaming machine by a flexible connector. Preferably, the retractable remote controller has at least one button and, most preferably, a set of buttons, to remotely play the game on the slot machine. The retractable remote controller can also have a cash-out button to remotely discharge collected coins in the slot machine into the script output receptacle. In one embodiment the retractable remote controller is hardwired to the slot machine by electric wires secured in a metal braided cable, or a nylon cord. In another form, the controller comprises a battery-operated and/or hand-held tethered device for operating the slot machine remotely that communicates with the machine by way of for example RF or IR. The controller can also have a card slot to receive a credit card or debit card, or a casino card, in order to activate the slot machine.

A more detailed explanation of the invention is provided in the following description and appended claims taken in conjunction with the accompanying drawings.

DETAILED DESCRIPTION OF THE PREFERRED EMBODIMENTS

Figure 1:
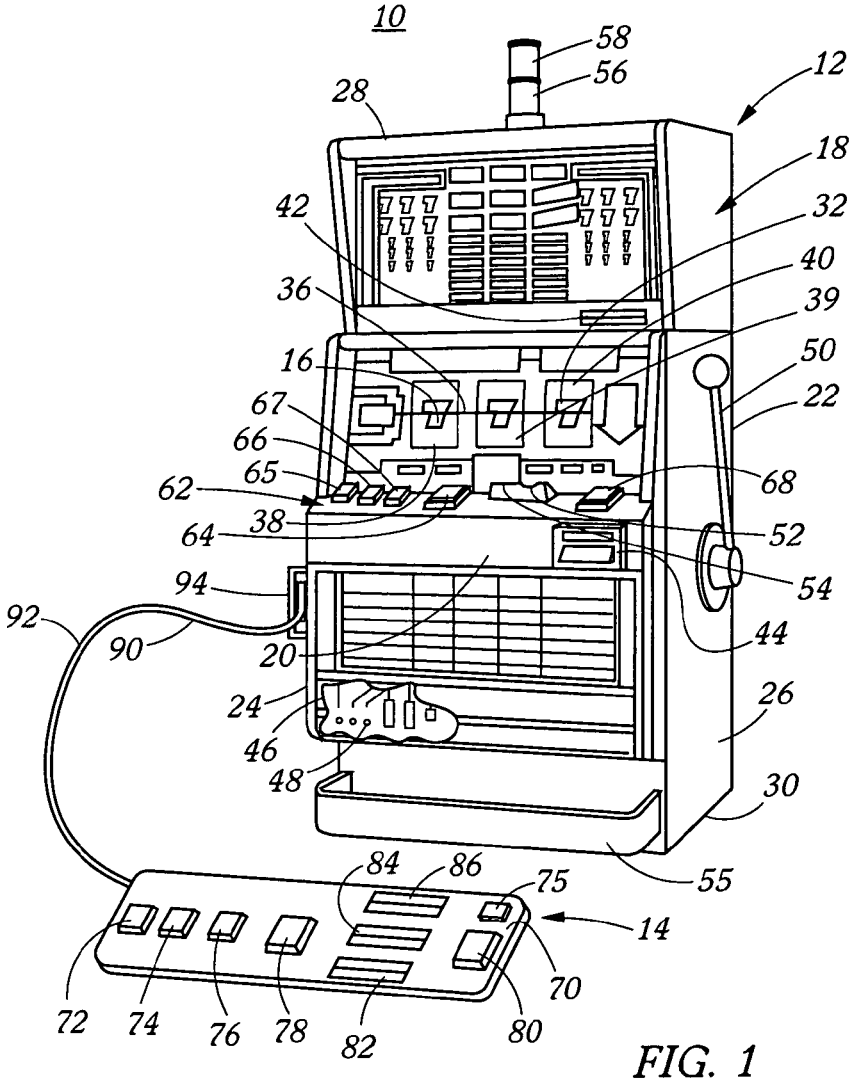
FIG. 1 is a perspective view of a "slot" type gaming machine having a lap-type, retractable, remote controller in accordance with one aspect of the present invention.

In FIG. 1, a "slot" type gaming machine having a retractable remote controller 10, includes a "slot" type gaming machine 12, and retractable remote controller 14, which provides a retractable remote controller to control the play of "slot" type gaming machine 12 remotely from the "slot" type gaming machine 12 while being tethered to the "slot" type gaming machine 12.

The "slot" type gaming machine 12 has a display 16, a housing 18. The "slot" machine-housing 18, has a front panel 20, a back panel 22, side panels 24 and 26, a top 28, a bottom 30, and a transparent display protection window 32 made of, for example, impact-resistant plastic or glass. The display protection window 32 can have a single horizontal pay line 36 or a criss-cross pattern of multiple play lines (not shown). Preferably, the game comprises at least three reels (wheels) 38–40 or simulated reels. The reels have indicia comprising symbols, such as: 7's, bells, cherries, rockets, bars, figures, wild symbols, bonus symbols, jack pot multipliers, etc. The "slot" type gaming machine can for example have a progressive jackpot and the play can comprise a two or three coin multiple games. The "slot" type gaming machine 12 also has a casino card reader 42, which allows the player to insert a casino issued card, which provides additional rewards for playing machines that accept such cards.

Positioned within the interior of the housing is an electronic device 46, such as a microprocessor, computer chip, circuit board or the like, which contains an electronic control circuit 48 to rotate or simulate the rotation of the reels, as well operate other components and parts of the "slot" type gaming machine 12 as further described below. A mechanical pull arm 50 can be provided to manually actuate the play. Alternatively, the mechanical pull arm 50 can be connected to the electronic circuit and electronic device to spin the reels.

The "slot" type gaming machine 12 also has a coin or token slot 52 with a chute 54 in the housing 18 to receive one or more metal coins or tokens to activate the game. The "slot" type gaming machine 12 can be programmed to receive one or more desired type of script, including tokens and coins of various denominations. A coin-output receptacle 55, which comprises, for example, a metal trough, tray, or container, is located in the lower portion of the housing 18 to receive metal coins or tokens upon dispensing a "cash-out" and/or a "payout." One or more indicator lights 56 and 58 can extend above the top of housing 18. Indicator lights are connected to the electronic circuit to signal a visual alarm when the jackpot has been achieved or if the slot machine has a malfunction or, in the case of the instant invention, the retractable remote controller has been tampered with or removed from its flexible connector as will be further discussed below.

The "slot" type gaming machine 12 can also have a stationary playing consol 62 upon which are disposed a plurality of buttons to activate various features of the machine. Desirably, the buttons on the "slot" type gaming machine 12 include at least one play or spin button 64, which is connected to the electronic circuit to spin the reels when the play button is depressed by the player's finger. The buttons of the "slot" type gaming machine can include, for example, a change button 65, a cash-out/payout button 66, a credit button 67, and a maximum spin button 68. The spin button 64 can play the credits chosen by the credits button 67. The maximum spin button 68 is connected to the electronic circuit and can spin the reels automatically for maximum bets per play, without the need to press the credit button 67 for each bet per play. The credits can be displayed on the display screen on the consol 62.

The retractable remote controller 14, as shown in FIG. 1, is designed to rest on the players lap and has a consol 70 having at least one play or spin button 72, a change button 74, a cash-out/payout button 76, a credit button 78, and a maximum spin button 80. The spin button 72 can play the credits chosen by the credit button 78. The spin button 72 and the maximum spin button 80 are connected to the electronic circuit. The maximum spin button 80 can spin the reels automatically for maximum bets per play, without the need to press the credit button 78 for each bet per play. The credits are displayed on the display screen on the consol 62.

The consol 70 also has a credit card slot 82 to receive a credit card to activate the game, a casino card slot 84 to receive a casino card, and a bill changer slot 86 to accept script or bills. A flexible connector 90 tethers the retractable remote controller 14 to and comprises a braided cable 92, which, in this embodiment, contains electrical wiring such that the buttons and devices on the consol 70 can electronically communicate with the electronically controlled circuitry of the "slot" type gaming machine 12, i.e. the retractable remote controller unit 14 is hard wired to the "slot" type gaming machine 12 by way of electronic device 46. Preferably, the flexible connector is alarmed (not shown), such that severing the flexible connector 90, or disengaging the retractable remote controller unit 14 from the "slot" type gaming machine 12 will activate the alarm. This type of alarm can be silent to a back room, visible such as through lights 56 and/or 58 or audible such as a siren or a bell. Such attached alarm systems are well known in the art.

The flexible connector 90 is retractable into the "slot" type gaming machine 12, which retracts attached retractable remote controller 14 to a position partially inside receiving sleeve 94 mounted on the side panel 24 of "slot" type gaming machine 12. There are many mechanisms known in the art for selectively retracting the flexible connector. For example, as shown in FIG. 2, the cable retraction device 95 can be a spring loaded reel, which allows the retractable remote controller 14 to play out to a comfortable playing position upon activation of the "slot" type gaming machine 12 and retracts the retractable remote controller 14 upon play termination.

Figure 2:
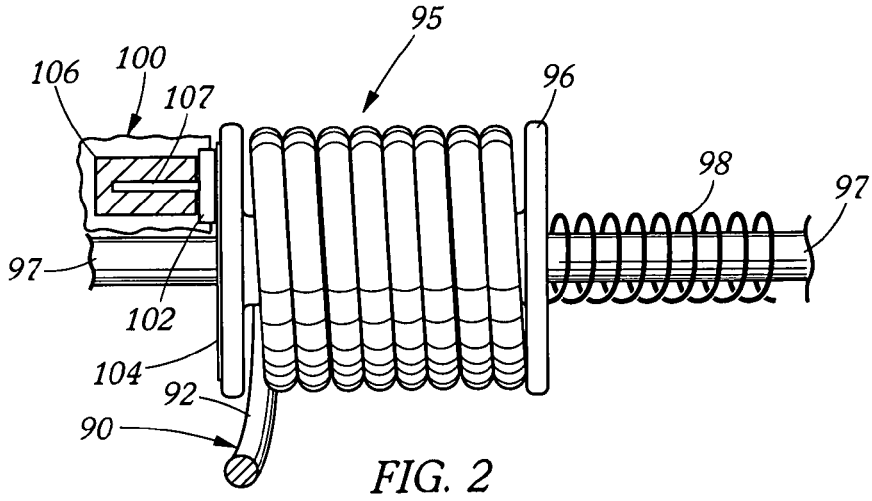
FIG. 2 is a perspective view of a spring-loaded reel for retracting the device in accordance with one aspect of the present invention.

In accordance with FIG. 2, there is shown a cable retraction device 95 having a bi-shouldered reel element 96, which is rotatably mounted on a spindle 97. A coil spring 98 engages reel element 96 such that, as the flexible connector 90 is played out, the coil spring 98 is tensioned allowing the flexible connector 90 to be positively retracted by rewinding the flexible connector 90 on the reel element 96. A braking device 100 is located proximate one shoulder of reel element 96 such that braking pad 102 of braking device 100 releasabley engages braking surface 104 on the side of the shoulder of reel element 96. An actuator 107 in solenoid 106 engages braking pad 102 to selectively engage and disengage the reel element 96.

In operation, a player activates the "slot" type gaming machine 12 by selectively entering script in the form of bills, coins, or tokens into the bill changer 44 or coin slot 52 or remote casino card slot 84 or using a credit card in card slot 82. Upon activation, braking device 100 is deactivated to allow reel element 96 to play out flexible connector 90, thus allowing removal of retractable remote controller 14 to an appropriate playing position. In one embodiment (not shown) the braking device 100 locks the flexible connector 90 after it is moved to a position of comfort for the player. Merely pulling on the flexible connector releases the cable-locking device, allowing the flexible connector 14 to be retracted, temporarily into receiving sleeve 94 such as in pause in play. Upon termination of play, braking device 100 is deactivated such that the retractable remote controller 14 is automatically retracted into the receiving sleeve 94. The braking device 100 is then reactivated upon complete retraction to securely lock the retractable remote controller 14 within receiving sleeve 94.

In play, the player activates the "slot" type gaming machine 12 by entry of the appropriate coins, script, etc. into the appropriate slot. The player then removes the retractable remote controller 14 from receiving sleeve 94 and adjusts the retractable remote controller 14 to a comfortable position for play, whereupon the braking device 100 is locked for play. When the spin button 72 on the retractable remote controller 14 is depressed, it sends a signal to the electronic circuit in the slot machine to spin the reels from a remote location spaced comfortably away from the display screen of the "slot" type gaming machine 12. As the reels spin, a series, or progression of symbols are displayed along the win line. After a brief period of spinning, each of the reels comes to rest at a discrete reel stop position. At each reel stop position, a particular part of the reel's periphery, i.e., a symbol, is displayed at the win line. The game outcome is the particular combination of symbols displayed at the win line.

The buttons of the retractable remote controller 14 can include: a cash-out/payout button 76, a change button 74, and a multiple spin button 75. The cash payout button, when depressed, can cause coins to be dispensed and discharged coins from the chute into the coin-output receptacle of the "slot" type gaming machine upon winning and/or cashing out. The spin button can play the credits chosen by the credits button. The multiple spin button is operatively connected to the remote controller circuit and signals the electronic circuit of the slot machine to spin the reels automatically for continuous games until the credits are depleted without the need to press the button for each game. The credits can be displayed on the display screen. The retractable remote controller can also include an interior containing a retractable remote controller circuit, such as a circuit board or computer chip. (not shown) At least part of the circuit in the retractable remote controller can be similar to part of the electronic control circuit 48, in the "slot" type gaming machine 12.

Figure 3:
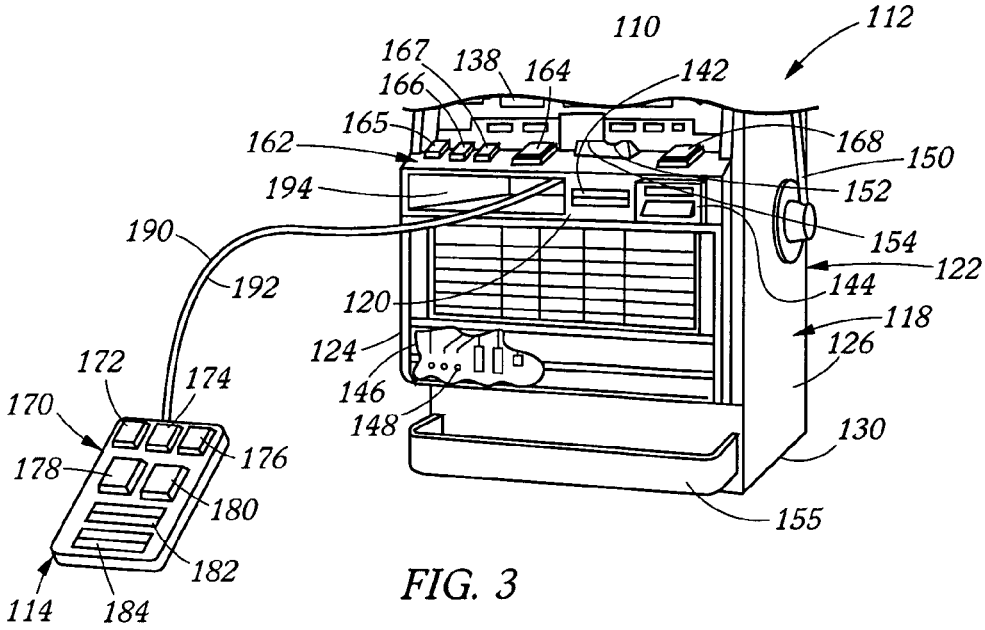
FIG. 3 is a partial cutaway perspective view of a hand held retractable remote controller for a "slot" type gaming machine in accordance with another aspect of the present invention; and, FIG. 4 is a perspective view of a "slot" type gaming machine having a retractable attached retractable remote controller, which replaces a standard consol in accordance with another aspect of the present invention.

Turning to FIG. 3, there is shown another embodiment of the instant invention, wherein the retractable remote controller 114 is a hand held device and retracts into a receiving sleeve 194, recessed into the front potion of housing 218. In FIG. 3, there is shown a cut away, partial view of "slot" type gaming device 110, including a "slot" type gaming machine 112 having a retractable remote controller device 114. As shown, the hand held, retractable remote controller 114, which provides a retractable remote controller to control the play of "slot" type gaming machine 112 retracts into receiving sleeve 194 when not in use or at the end of play.

The "slot" type gaming machine 112 has a display (not shown), a housing 118. The slot machine-housing 118, has a front panel 120, a back panel 122, side panels 124 and 126, a top (not shown), and a bottom 130. The "slot" type gaming machine 112 can, for example, have a progressive jackpot and the play can comprise a two or three coin multiple games. The "slot" type gaming machine 112 also has a casino card reader 142, which allows the player to insert a casino issued card, which provides additional rewards for playing machines that accept such cards.

Positioned within the interior of the housing is an electronic device 146, such as a microprocessor, computer chip, or circuit board which contains an electronic control circuit 148 to rotate or simulate the rotation of the reels, as well operate other components and parts of the slot machine, as further described below. A mechanical pull arm 150 can be provided to manually actuate the play. Alternatively, the mechanical pull arm 150 can be connected to the electronic circuit and electronic device to spin the reels.

The "slot" type gaming machine 112 also has a coin or token slot 152 with a chute 154 in the housing 118 to receive one or more metal coins or tokens to activate the game. The "slot" type gaming machine 112 can be programmed to receive one or more desired type of script, including tokens and coins of various denominations. A coin-output receptacle 155, which comprises, for example, a metal trough or tray, is located in the lower portion of the housing 118 to receive metal coins or tokens upon dispensing a "cash-out" and/or a "payout." One or more indicator lights (not shown) can extend above the top of housing 118. Indicator lights are connected to the electronic circuit to signal a visual alarm when the jackpot has been achieved or if the slot machine has a malfunction or, in the case of the instant invention; the retractable remote controller 114 has been tampered with or the flexible connector 190 is severed.

The "slot" type gaming machine 112 has a stationary playing consol 162, upon which are a plurality of buttons to activate various features of the machine. Desirably, the buttons on the "slot" type gaming machine include at least one play or spin button 164, which is connected to the electronic circuit to spin the reels when the play button is depressed by the player's finger. The buttons of the "slot" type gaming machine can include, for example, a change button 165, a cash-out/payout button 166, a credit button 167, and a maximum spin button 168. The spin button 164 can play the credits chosen by the credits button 167. The maximum spin button 168 is connected to the electronic circuit and can spin the reels automatically for maximum bets per play, without the need to press the credit button 167 for each bet per play. The credits can be displayed on the display screen on the consol 162.

The retractable remote controller 114 is designed for hand held play and has a casing 170 which can be gripped or placed, for example, upon the arm of a chair. The retractable remote controller 114 has at least one play or spin button 172, a change button 174, a cash-out/payout button 176, a credit button 178, and a maximum spin button 180. The spin button 172 can play the credits chosen by the credit button 178. The spin button 172 and the maximum spin button 180 are connected to the electronic circuit. The maximum spin button 180 can spin the reels automatically for maximum bets per play, without the need to press the credit button 178 for each bet per play. The credits are displayed on the display screen on the consol or the retractable remote controller 114 (not shown.)

The casing 170 also has a card slot 182 to receive a credit card to activate the game, and a casino card slot 184 to receive a casino card. Flexible connector 190 is hardwired to the retractable remote controller 114 and the "slot type" gaming machine 112 and comprises a braided cable 192 which contains electrical wiring, such that the buttons and devices on the casing 170 can electronically communicate with the electronically controlled circuitry of the "slot" type gaming machine 112. Preferably, the cable is alarmed, such that severing the braided cable 192, or severing the flexible connector 190 will activate the alarm. This type of alarm can be silent to a back room, visible such as through lights (not shown) or audible such as a siren or a bell. Such attached alarm systems are well known in the art.

The flexible connector 190 is retractable into the "slot" type gaming machine 112, which retracts attached retractable remote controller 114 to a position partially inside receiving sleeve 194 mounted on the front panel 120 of "slot" type gaming machine 112. There are many mechanisms known in the art for selectively retracting the flexible connector.

In accordance with another embodiment, the flexible connector 190 can comprise a rope, cable, or other non-conductive flexible connector to tether the retractable remote controller 114. In this embodiment, communication between the retractable remote controller 114 and the "slot" type gaming machine 112, is provided by IR or RF signals in a manner well known in the art. Power to the retractable remote controller 114 can be provided by, for example, batteries or a separate power supply. In accordance with this embodiment, the flexible connector 190 acts solely as a tether, which is retracted and played out in a manner as described above.

Figure 4:
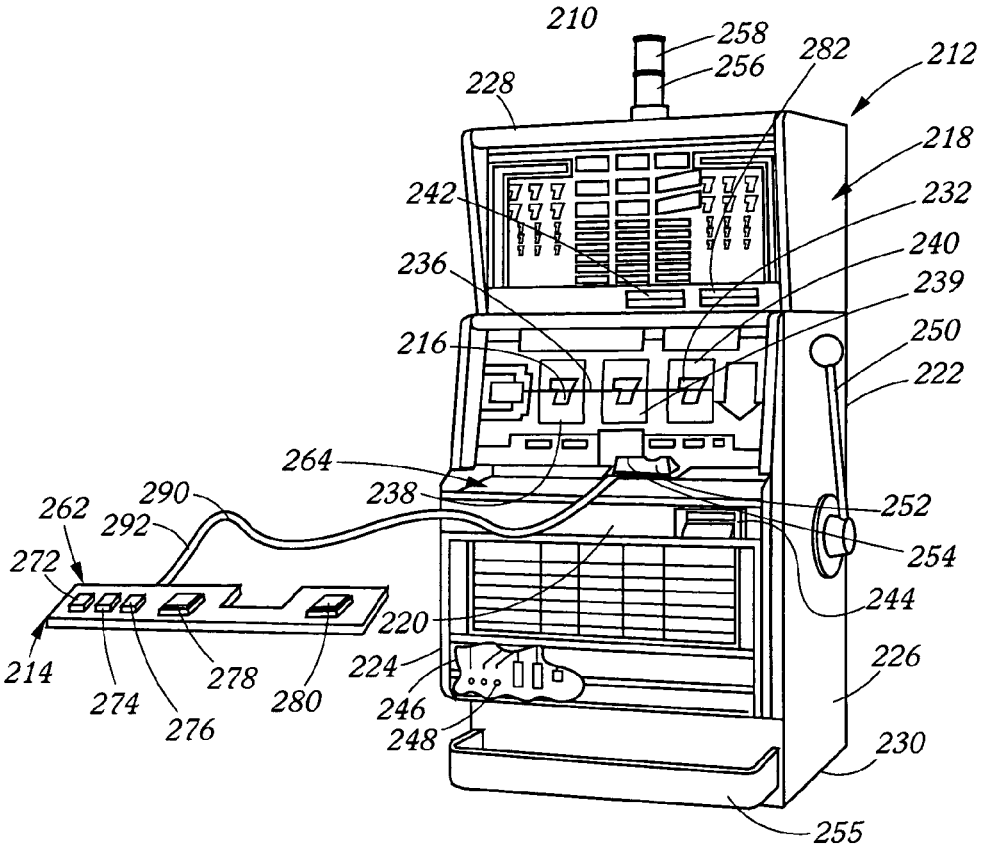

Turning now to FIG. 4, there is shown a further embodiment of the instant invention, wherein the consol 262 can remain in its standard position, proximate the "slot" type gaming machine 212, or is removable but attached to a flexible connector 290 as shown. In FIG. 4, a "slot" type gaming device 210 including a "slot" type gaming machine 212 having a retractable remote controller device 214, includes the "slot" type gaming machine 212, and retractable remote controller 214, which provides a remote control unit to control the play of "slot" type gaming machine 212.

The "slot" type gaming machine 212 has a display 216, a housing 218. The slot machine-housing 218, has a front panel 220, a back panel 222, side panels 224 and 226, a top 228, a bottom 230, and a transparent display protection window 232 made of, for example, impact-resistant plastic or glass. The display protection window 232 can have a single horizontal pay line 236 or a criss-cross pattern of multiple play lines (not shown). Preferably, the game comprises at least three reels (wheels) 238–240 or simulated reels. The reels have indicia comprising symbols, such as: 7's, bells, cherries, rockets, bars, figures, wild symbols, bonus symbols, jack pot multipliers, etc. The "slot" type gaming machine 212 can for example have a progressive jackpot and the play can comprise a two or three coin multiple games. The "slot" type gaming machine 212 also has a casino card reader 242, which allows the player to insert a casino issued card, which provides additional rewards for playing machines that accept such cards.

Positioned within the interior of the housing is an electronic device 246, such as a microprocessor, computer chip, or circuit board, which contains an electronic control circuit 248 to rotate or simulate the rotation of the reels, as well as operate other components and parts of the slot machine, as further described below. A mechanical pull arm 250 can be provided to manually actuate the play. Alternatively, the mechanical pull arm 250 can be connected to the electronic circuit and electronic device to spin the reels.

The "slot" type gaming machine 212 also has a coin or token slot 252 with a chute 254 in the housing 218 to receive one or more metal coins or tokens to activate the game. The "slot" type gaming machine 212 can be programmed to receive one or more desired type of script, including tokens and coins of various denominations. A coin-output receptacle 255, which comprises, for example, a metal trough, or tray, is located in the lower portion of the housing 218 to receive metal coins or tokens upon dispensing a "cash-out" and/or a "payout." One or more indicator lights 256 and 258 can extend above the top of housing 218. Indicator lights are connected to the electronic circuit to signal a visual alarm when the jackpot has been achieved or if the slot machine has a malfunction or, in the case of the instant invention, the retractable remote controller 214 has been tampered with or the flexible connector 290 has been severed.

In accordance with this aspect of the invention, the "slot" type gaming machine 212 has removable, retractable playing consol 262, which is placed in securing receptacle 264 on the front of "slot" type gaming machine 212. Consol 262 can be operated in its standard position, or removed upon play activation to form a retractable playing consol flexibly connected to the "slot" type gaming machine 212, which can be placed in, for example, the players lap. The consol 262 contains a plurality of buttons to activate various features of the machine.

The retractable remote consol controller 262 is designed to remain in receptacle 264 on the front of "slot" type gaming machine 212 or when removed, to rest on, for example, the players lap and has at least one play or spin button 272, a change button 274, a cash-out/payout button 276, a credit button 278, and a maximum spin button 280. The spin button 272 can play the credits chosen by the credit button 278. The spin button 272 and the maximum spin button 280 are connected to the electronic circuit. The maximum spin button 280 can spin the reels automatically for maximum bets per play, without the need to press the credit button 278 for each bet per play. The credits are displayed on the display screen on the consol 262.

The consol 262 in addition to a plurality of buttons can also contain a plurality of card slots (not shown.) These slots can be mounted upon the housing 218, as shown, or on the consol 262, or both. A flexible connector 290 is hardwired to the retractable remote consol 262 and the "slot" type gaming machine 212 and comprises a braided cable 292, which contains electrical wiring, such that the buttons and devices on the retractable remote consol 262 can electronically communicate with the electronically controlled circuitry of the "slot" type gaming machine 212. Preferably, the flexible connector 290 is alarmed (not shown), such that severing the flexible connector 290, or severing the flexible connector between the retractable remote consol 262 and the "slot" type gaming machine 212 will activate the alarm. This type of alarm can be silent to a back room, visible such as through lights 256 and/or 258 or audible, such as a siren or a bell. Such attached alarm systems are well known in the art.

The flexible connector 290 is retractable into the "slot" type gaming machine 212, which retracts attached retractable remote consol 262 to a position within 264. The methods of retraction are well known in the art, an example having been previously set forth herein. It will be realized that the flexible connector, which attaches the retractable remote controller 214, acts as a hardwired electronic connection and tethers the retractable remote consol 262 to flexibly restrict the range of the retractable remote consol 262. Other materials can be used for this tethering function depending on the requirements. If the electrical pulses and signals generated and emitted by the retractable remote controller are transmitted to the circuit of the slot machine via the flexible connector, then a conducting cable (wires) is necessary. In this case, the retractable remote controller is hard-wired to the machine by wires that extend between and connects the retractable remote controller to the electronic circuits in the slot machine. In other embodiments the flexible connector acts solely to flexibly restrain, or tether, the retractable remote controller 214 and communication between the retractable remote controller 214 and the "slot" type gaming machine 212 is accomplished by, for example, IR or RF as previously described.

In one form, the "slot" type gaming machine and/or the retractable remote controller has a bill-receiving slot 244 to receive paper currency, such as one dollar bill, five dollar bill, ten dollar bill, fifty dollar bill, one hundred dollar bill, etc., in order to activate the game. The "slot" type gaming machine can further have a card slot to receive a credit card or debit card to activate the game. Instead of receiving a coin payout, the player can elect to receive payment or credit on the player's credit card or debit card. Advantageously, the retractable remote controller can simultaneously control two, three, or more similar slot machines, if desired by the player.

Preferably, the "slot" type gaming machine is a reel-type slot machine, with three mechanical symbol-bearing reels, or a video display thereof, within a housing. The reels rotate in response to a player actuation after one or more coins are inserted into a coin input slot. The gaming machine can include an electronic control circuit with a microprocessor, which stops each of the reels at random positions. As the reels come to a stop, different combinations of symbols for indicia will appear adjacent to a win line. The microprocessor will determine if the combination of indicia stopped on the win line matches one of a number of predetermined winning combinations. If a match is found, a win occurs and the microprocessor generates a pay signal, which can cause a coin hopper to payout, through a payout chute, a specified number of coins or tokens, or increment a credit counter, or provide a signal to an attendant to provide the payout.

The player generally controls the number of coins dispensed for a win in relation to the odds that a particular combination will occur and the number of coins inserted. The number of coins dispensed for a particular winning combination of symbols can be determined by a pay schedule. A number of different pay schedules can be provided, each of which may be dynamically selected during operation of the slot machine. These schedules can be displayed in a top glass portion of the slot machine. The microprocessor is electronically operatively connected via the input/output board to the retraction device, which regulates the extension and/or retraction of the retractable remote controller by way of regulating the scope of extension of the flexible connector, such that the controller is allowed to play out when the machine is activated for play and retracts when the play is terminated.

The microprocessor in the slot machine can also be operatively connected to the handle, which generates a handle signal that indicates when the handle is pulled. The microprocessor can further be operatively connected to a coin hopper that is responsive to a pay signal, which causes the coin hopper to dispense a designated number of coins. The microprocessor can also be operatively connected to a coin acceptor that generates a coin signal, which indicates the number of coins inserted by a player into the coin slot.

In the "slot" type gaming machine, the microprocessor can control each of the reels through a reel control mechanism. The reel control mechanism can include a stepper motor or the like for each of the reels to start and stop the rotation of the reels in accordance with signals from the microprocessor. The reel control mechanism can also be coupled to an input/output board, which is responsive to the microprocessor for selecting a particular one of the stepper motor controls to receive control data from a data bus. Alternatively, the game control microprocessor can display video representations of physical reels on a display screen comprising a video monitor.

In operation, the microprocessor can select one of the pay schedules in the columns by examining the coin signal and the contents of an event counter. If a player inserts only one coin into the coin slot, prior to pulling the handle, then the microprocessor can select the pay schedule in one column. If the player inserts two coins, the microprocessor selects the pay schedule in another column. If the player inserts three coins, the microprocessor selects the pay schedule in a further column. Each of the schedules in the columns can be assigned to a range of values, which the event counter may contain. The microprocessor can select the pay schedule whose assigned range includes the current value of the contents of the event counter.

During normal gaming machine operation, the microprocessor after selecting the stop positions of reels, determines which symbols on the reels are stopped at the win line and searches the column in the pay table for a winning combination of symbols. If a match is located, the microprocessor can determine a pay amount corresponding to the winning combination. The microprocessor can then generate a pay signal through an input/output chip that causes a coin hopper to pay out through the coin chute that number of coins equivalent to the selected payout amount.

The microprocessor can control the slot machine in accordance with programs and data stored in a memory. This includes playing out or retracting the retractable remote controller. The memory can be coupled to the microprocessor by address and data lines or a bus. A game outcome logic circuit can also be connected to the microprocessor. An input-output controller in the "slot" type gaming machine can provide an interface between the microprocessor and various sensors. One sensor can generate a signal to indicate when the player has accessed the controller. A second can detect if the controller or the flexible connector have been tampered with. Another sensor can generate a coin-input signal to indicate when the player has inserted coins into the coin slot, which can release the retractable remote controller. An input-output controller can cooperate with a sensor to generate a control signal to actuate the coin hopper to discharge coins into the tray upon winning and to retract the retractable remote controller upon termination of play.

Game play is initiated when the microprocessor detects that a player has inserted a coin and pulled the handle. The microprocessor can query a game outcome logic circuit to determine a randomly selected reel stop position for at least one of the reels. The combination of selected reel stops is the game outcome. The microprocessor can signal the selected reel stops positions to a reel control mechanism. The reel control mechanism call set the reels into motion with a motor. The reels are allowed to spin for a short time, and then are stopped at the selected reel stop positions. Symbols on each of the reels correspond to the selected reel stops and are displayed at the win line. The game results can be determined by microprocessors in cooperation with a game outcome logic circuit. Instead of mechanical reels, a video display can be used. The video system is comparable to the mechanical system, except that in place of the reel control mechanism, a video control interface circuit can be provided. The interface circuit allows the microprocessor to generate video display of the game result displayed on a video screen. The video display is a representation of spinning reels. Other suitable displays and symbols can be provided.

One to three coins or more can be deposited to play the "slot" type gaming machine. Upon input of a coin into a coin entry slot, the retractable remote controller is released and a single win line is made active. The active state of the win line can be signaled to a player by lighting of a lamp or light, corresponding to the win line in the display window of the housing. In the front of the housing, there can also be a credit button and a coin entry button. If the player depresses the credit button, the number of coins to the player's credit can be displayed on a credit number display.

When the player pulls a start lever comprising the pull handle or the spin button, after inserting coins into the coin input slot, the reels rotate so that display symbols on the reels rotate. When a predetermined time period has elapsed after the reels have rotated, the reel can be stopped in a sequential manner. If a combination of symbols stopped at the will line corresponds to a winning combination, payout of coins will be dispensed into the payout tray or a credit will be displayed, as per the player's option.

One or more coins can be inserted into a slot in a coin acceptor mechanism of the "slot" type gaming machine. After the microprocessor has determined that the coin or coins are valid, a coin-in switch can activate the circuit to release the retractor lockdown mechanism to release the flexible connector. This allows the retractable remote controller to be played out on the flexible connector. The enabled retractable remote controller can be played out to a comfortable position for the player. The retractable remote controller is enabled. The remote spin button can then be depressed.

Scoring control and payout circuitry can be provided to actuate a motor to discharge coins from a hopper if the game is a winner. Coins corresponding to the payout can be discharged from the payout hopper through a coin payout mechanism to the payout tray at the front of the "slot" type gaming machine. A hopper coin detector can sense the level of coins in the hopper. When the hopper is full coins, a mechanical diverter to a drop box can divert input into the slot. Once payout or cash-out has been achieved or the player has spent his credits, the microprocessor sends a signal to retract the retractable remote controller to return it to its resting position.

Control of the functions of the "slot" type gaming machine can be through a central processing unit (CPU), such as computer, microprocessor, computer chip, or logic control board. The CPU can produce a random number generator for each reel and can select a number corresponding to a reel position for each reel. The random members generated can actuate a brake mechanism through circuitry to stop each reel in order. The CPU can also control the releasing of the handle lockout mechanism and the flexible connector braking device when the coin-in switch has been triggered and the coin has been accepted. The CPU can further control a coin lockout device and can control the starting and stopping of the reels. The CPU also randomly determines winning or losing of the game and the disbursement of coins if there is a winner. A sensor on the CPU keeps track of the play out of the flexible connector, so that the retractable remote controller can be returned after play if it has been extended.

The number of coins, which have been paid, can determine by a sensor, which provides one or more pulses to an input line of the microprocessor. The microprocessor can communicate through a bi-directional serial communications link to a primary microcomputer, so that it receives signals concerning the number of coins to be paid when there is a win. After the payout logic and hopper control has generated the payout through the hopper motor, the information as to the payout can be communicated to the primary microcomputer.

The primary microcomputer or microprocessor can also communicate with reel drivers. Each reel driver controlled microcomputer can comprise a single chip microprocessor. Each reel driver can also be connected to a motor associated with each of the reels. Each motor can be a stepper motor and can be located within the annulus of its respective reel.

The microprocessor can determine the positions of the reels. This information is processed and transmitted by the microprocessor to set the initial positions of the reels. The primary microcomputer communicates with all of the microprocessors associated with the various reel drivers and can provide a command to start all reels in motion after the microprocessor has determined that the game is to commence by either rotation of the pull handle or a depression of the push button. After the primary microprocessor has calculated a random number and determines whether a winning game or losing game has resulted, and has determined an appropriate reel combination to display, the information can be communicated to the respective microprocessor of each reel driver which counts the steps that the motor has made, i.e., the number of pulses received, and stops the rotation of the motor in accordance with the information received from the primary microprocessor. This can be accomplished in sequence, so that the primary microprocessor awaits information from each motor driver in succession to report that the associated reel has stopped successfully and then the primary microprocessor proceeds to address the subsequent drivers.

It is to be understood that rather than utilizing a primary microprocessor in conjunction with the other microprocessors, a single microprocessor, or CPU can be utilized to control and operate the entire gaming system and "slot" type gaming machine. In electronic machines, a CPU controls the reels. In effect, the computer or microprocessor comprising the CPU determines the game outcome.

As indicated above, in some "slot" type gaming machines, the reels are eliminated altogether, and the game outcome is displayed on a video screen. The video display is often a representation or facsimile of spinning reels, to preserve the charm and excitement of the traditional "slot" type gaming machine. To simulate the effect of a spinning reel, the video screen displays a series or progression of symbols, which appear to move past a win line.

The foregoing discussions, and examples, describe only specific embodiments of the present invention. It should be understood that a number of changes might be made, without departing from its essence. In this regard, it is intended that such changes—to the extent that they achieve substantially the same result, in substantially the same way—would still fall within the scope and spirit of the present invention.

What is claimed is:

1. A gaming device having a tethered, remote controller for spaced apart operation comprised of:

a "slot" type gaming machine, including at least one indicator to communicate to the player the outcome of the game, a monetary input slot to receive the gaming script to activate the game for play; at least one initiator to initiate play; at least one script dispenser for dispensing script which includes winnings of the play;

a tethered remote controller, associated with said "slot" type gaming machine for spaced apart operability of said "slot" type gaming machine; and, a flexible extendible and retractable tether, for attaining an attached, spaced apart, operating relationship between said tethered remote controller and said "slot" type gaming machine, means for, releasing the tethered remote controller from a position proximate said "slot" type gaming machine for play upon activation of said "slot" type gaming machine; and, retracting said tethered remote controller upon termination of play of said "slot" type gaming machine to return the tethered retractable remote controller to a position proximate said "slot" type gaming machine.

2. The gaming device in accordance with claim 1 wherein activation of said "slot" type gaming machine for play also activates said tethered remote controller for play.

3. The gaming device in accordance with claim 1 wherein said gaming device is alarmed to indicate tampering with said tethered remote controller or the severing of said flexible tether.

4. The gaming device in accordance with claim 1 wherein said tethered remote controller is hardwired to said, "slot," type gaming machine.

5. The gaming device in accordance with claim 1 wherein said tethered remote controller comprises a battery-operated unit and operates said "slot" type gaming machine through IR or RF interface.

6. The gaming device in accordance with claim 1 wherein said tethered remote controller is selected from hand held units and lap held units.

7. The gaming device in accordance with claim 1 wherein said tethered remote controller further contains a credit button for displaying credits; and, a multiple spin button operatively connected to said "slot" type gaming machine for spinning said reels of said slot machine for continuous games until the credits are depleted.

8. The gaming device in accordance with claim 1 wherein said position proximate said "slot" type gaming machine comprises a recess within the housing of said "slot" type gaming machine or a sleeve attached to said housing.

9. The gaming device in accordance with claim 1 wherein said "slot" type gaming machine further contains a consol having a plurality of buttons corresponding to operations of said "slot" type gaming machine and said consol can be removed from said "slot" type gaming machine to operate said "slot" type gaming machine as said tethered remote controller.

10. The gaming device in accordance with claim 9 wherein said plurality of buttons is selected from a group consisting of a spin button, a change button, a cash-out/payout button, a credit button, and a maximum spin button.

11. A method for operating a gaming device from a remote controller tethered to said gaming device by a flexible extendable and retractable tether for attaining an attached, spaced apart, operating relationship between said gaming device comprised of a "slot" type gaming machine having at least one indicator to communicate to the player the outcome of the game, a monetary input slot to receive the gaming script to activate the game for play, at least one initiator to initiate play, at least one script dispenser for dispensing script which includes winnings of the play and the remote controller comprising the steps of:

initiating play of the "slot" type gaming machine to release said tethered remote controller from a position proximate said "slot" type gaming machine; and, terminating play of said "slot" type gaming machine to return said tethered remote controller to a position proximate said "slot" type gaming machine.

12. The method for operating a gaming device from the remote controller in accordance with claim 11 further comprising playing out the flexible tether attached on one end to said tethered retractable remote controller for attaining a tethered, spaced apart, operating relationship between said tethered retractable remote controller and said "slot" type gaming machine upon activation.

13. The method for operating a gaming device from the remote controller in accordance with claim 11 wherein activation of said "slot" type gaming machine for play also activates said remote controller for play.

14. The method for operating a gaming device from the remote controller in accordance with claim 11 wherein said gaming device is alarmed to indicate tampering with said remote controller or severing the flexible tether from said "slot" type gaming machine.

15. The method for operating a gaming device from the remote controller in accordance with claim 11 wherein said remote controller is hardwired to said, "slot," type gaming machine.

16. The method for operating a gaming device from the remote controller in accordance with claim 11 wherein said remote controller comprises a battery-operated unit and operates said, "slot," type gaming machine through IR or RE interface.

17. The method for operating a gaming device from the remote controller in accordance with claim 11 wherein said remote controller is selected from hand held units and lap held units.

18. The method for operating a gaming device from the remote controller in accordance with claim 11 wherein said position proximate said "slot" type gaming machine comprises a recess within the housing of said "slot" type gaming machine or a sleeve attached to said housing.

19. The method for operating a gaming device remotely from the remote controller in accordance with claim 11 wherein said "slot" type gaming machine further contains a consol having a plurality of buttons corresponding to operations of said "slot" type gaming machine and said consol can be removed from said "slot" type gaming machine to operate said "slot" type gaming machine as said remote controller.

20. A gaming device having a handheld remote controller for attaining an attached, spaced apart, operating relationship between said remote controller and a "slot" type gaming machine comprised of:

a slot"type gaming machine, having a housing; a display screen having single or multiple pay lines for displaying a game, said game comprising at least three reels or simulated reels, said reels have indicia comprising symbols; a coin-input slot with a coin chute in said housing for receiving at least one coin to activate the game; a microprocessor coupled to an electronic circuit for affecting rotation or simulating the rotation of said reels and controlling the gaming functions of said "slot" type gaming machine, wherein at least part of said electronic circuit is selected from the group consisting of a microprocessor, a computer chip, or circuit board; at least one indicator light connected to said circuitry for signaling an alarm; a mechanical lever comprising a manual pull handle extending laterally outwardly of said housing and connected to said electronic circuit to spin said reels, a coin-output receptacle comprising a trough, in a portion of said housing for receiving coins upon payout of the game; a recess in the front portion of said housing for placing a hand held remote controller therein; and a consol on said housing containing at least one play button connected to said circuit for spinning said reels and a credit button for displaying credits on said consol of said slot machine;

a hand-held remote controller, tethered to said gaming device by a flexible extendable and retractable tether manually moveable about a front portion of said "slot" type gaming machine and associated with said "slot" type gaming machine for spaced apart operability of said "slot" type gaming machine, having an array of manually depressible buttons wherein at least one button transmits a signal to said electronic circuit in said "slot" type gaming machine to spin said reels from a location spaced from said "slot" type gaming machine, a multiple spin button for spinning multiple games operatively connected to said electronic circuit of said "slot" type gaming machine for spinning said reels of said "slot" type gaming machine from a location spaced from "slot" type gaming machine; a payout button for remotely discharging coins from said chute into said coin-output receptacle of said slot machine upon winning or payout of the game; a card slot for receiving a credit card or debit card to activate said "slot" type gaming machine; a flexible tether, protruding from said recess in the front portion of said housing, for hardwiring said handheld remote controller to said electronic circuitry of said "slot" type gaming machine, for attaining a tethered, spaced apart, operating relationship between said remote controller and said "slot" type gaming machine, wherein said tether is operatively extendable and retractable by means of a spring loaded reel within said "slot" type gaming machine around which the tether is coiled such that activation of said "slot" type gaming machine for play, causes said electronic circuitry to release the reel to allow the handheld remote controller to be removed from said recess and extended to any position along the length of the flexible tether for spaced apart play of said "slot" type gaming machine, and termination of play of said "slot" type gaming machine initiates said electronic circuitry to retract said flexible tether about the spring loaded reel to return said handheld retractable remote controller to said recess in the front portion of said housing.

* * * * *